US008137528B2

(12) United States Patent
Heselmans

(10) Patent No.: US 8,137,528 B2
(45) Date of Patent: Mar. 20, 2012

(54) APPLICATIONS FOR SACRIFICIAL ANODES

(76) Inventor: Johannes Jacobus Maria Heselmans, SC Hoofddorp (NL)

( * ) Notice: Subject to any disclaimer, the term of this patent is extended or adjusted under 35 U.S.C. 154(b) by 494 days.

(21) Appl. No.: 12/298,949

(22) PCT Filed: May 1, 2007

(86) PCT No.: PCT/NL2007/000113

§ 371 (c)(1),
(2), (4) Date: Oct. 29, 2008

(87) PCT Pub. No.: WO2007/126308

PCT Pub. Date: Nov. 8, 2007

(65) Prior Publication Data

US 2009/0065367 A1 Mar. 12, 2009

(30) Foreign Application Priority Data

May 1, 2006 (NL) ..... 1031726

(51) Int. Cl.
*C23F 13/20* (2006.01)
*C23F 13/22* (2006.01)

(52) U.S. Cl. ..... 205/730; 205/725; 205/731; 205/732; 205/733; 205/736; 205/740

(58) Field of Classification Search ..... 205/724, 205/725, 726, 727, 730, 731, 732, 733, 736, 205/740
See application file for complete search history.

(56) References Cited

U.S. PATENT DOCUMENTS

| | | | | |
|---|---|---|---|---|
| 3,360,452 | A | 12/1967 | McNulty | |
| 4,795,537 | A | 1/1989 | Timewell | |
| 5,350,494 | A * | 9/1994 | Brummelhuis | 204/196.05 |
| 7,064,459 | B1 * | 6/2006 | Staerzl | 307/95 |
| 2007/0041133 | A1 * | 2/2007 | Miermans | 361/18 |

FOREIGN PATENT DOCUMENTS

GB 2132226 7/1984

OTHER PUBLICATIONS

International search report in corresponding PCT/NL2007/000113.

* cited by examiner

*Primary Examiner* — Bruce Bell
(74) *Attorney, Agent, or Firm* — Young & Thompson

(57) ABSTRACT

This invention relates to protection of a metal component exposed to a corroding medium. One or more of the following are provided: cathodic protection, measuring of a condition of the component, retarding or avoiding of fouling. A sacrificial anode is used as the energy source such that the electric circuit can provide a pulsating current, voltage, automatically adapted current, or protecting potential. Germanium solid state elements are used.

16 Claims, 1 Drawing Sheet

APPLICATIONS FOR SACRIFICIAL ANODES

CROSS-REFERENCE TO RELATED APPLICATIONS

The present application claims priority to International Application No. PCT/NL2007/000113 filed May 1, 2007 and Netherlands Application 1031726 filed May 1, 2006.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

This invention relates to application of sacrificial anodes, particularly for high quality stainless steel alloys (hereafter named RVS).

2. Description of Related Art

Generally, the sacrificial anode consists of a zinc, aluminium or magnesium alloy. A specific field of application of the invention is provided by tubes, conduits, reaction vessels, heat exchangers and different components designed to contain a corroding medium (gas or liquid). With said field of application, the sacrificial anode is present within the relative component such that it is flooded by the corroding medium and can thus do its job. The invention is however also applicable to different metal structures, particularly of steel.

On the one hand a component can be protected against corrosion with the invention (cathodic protection).On the other hand a condition of the component can be measured with the invention, such as the amount of biologic fouling. Besides biologic fouling can be prevented or limited with the invention. For cathodic protection (hereafter named CP), you are referred to guideline NORSOK RP B401 as an example.

Particularly with RVS it is already known, to apply sacrificial anodes with an in series connected resistor or diode for CP. The resistor or diode provides a current limitation. In that manner it is prevented that the sacrificial anode gets exhausted or crumbles, while hydrogen brittleness of the RVS takes place. It is found out that this manner of CP functions well with a constant galvanic conductance/specific resistance of the corroding environment, like (sea) water.

BRIEF SUMMARY OF THE INVENTION

According to the invention the object is, to use the sacrificial anode as the energy source to supply a pulsating current and/or voltage and/or automatically adapt the, e.g.

with changing conductance/specific resistance of the (corroding) medium, by the sacrificial anode supplied galvanic/electric current and/or protection potential. By making use of the own galvanic/electric power of the sacrificial anode, e.g. (solid state) circuits can be supplied. Also the by the sacrificial anode provided potential can be changed into a higher potential. It will be appreciated that besides the sacrificial anode no further voltage or current source has to be used.

On the one hand the object is in this connection to make use of solid state elements (transistors, diodes, etc.) based on a material different from silicon. Preferably such a solid state element has a threshold voltage of 0.5 Volt or 0.3 Volt at the most. A convenient solid state component is in this respect made of germanium, which as is known has a threshold voltage of 0.3 Volt.

On the other hand the object is in this connection to allow the sacrificial anode to supply pulsating energy. This can e.g. be obtained by connecting the sacrificial anode to a convenient electrical circuit, such as an astabile multivibrator.

Thus preferably according to the invention the sacrificial anode is by interposition of an active element or switching element galvanically connected to the metal structure.

BRIEF DESCRIPTION OF THE SEVERAL VIEWS OF THE DRAWINGS

The invention will now be illustrated by way of a non-limiting example, referring to the enclosed drawing.

DETAILED DESCRIPTION OF THE INVENTION

Figure 1:
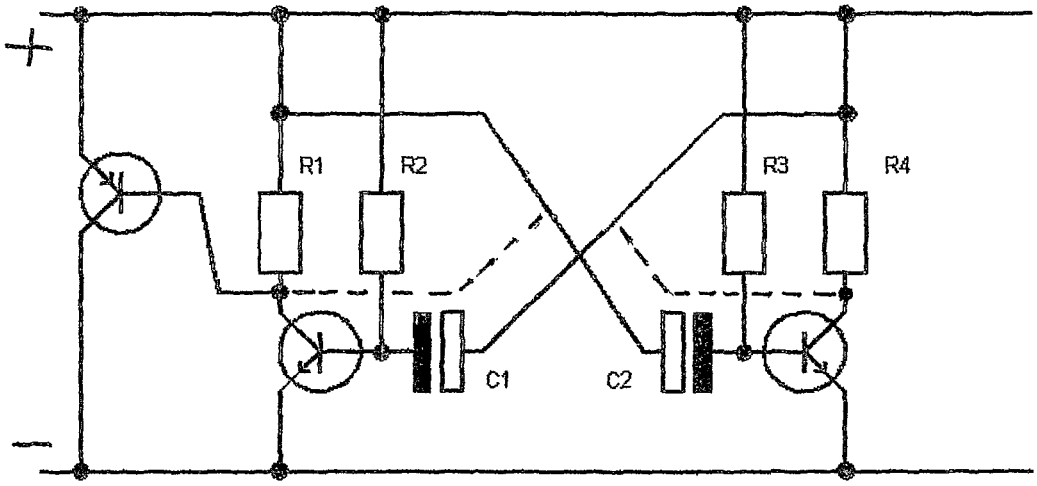
FIG. 1 shows a switching circuit.

FIG. 1 shows an astabile multivibrator with three germanium transistors, to which on the one hand the sacrificial anode and on the other hand de metal structure is connected. Sacrificial anode and metal structure are exposed to the same (galvanic conducting) medium. The sacrificial anode is via the astabile multivibrator galvanically/electrically conducting connected to the metal structure, e.g. through a wire. The sacrificial anode supplies a direct current (DC) that is transferred by the astabile multivibrator into alternating current (AC). Thus a pulsating potential is supplied to the metal structure. In that manner one can provide corrosion protection or fouling prevention and/or growth of a bio film can be measured. If the metal structure is made of RVS and the medium has a specific resistance of 500 Ohm.cm (e.g. with ozone saturated water), the open circuit potential is 1.2 Volt with an aluminium and 1.6 Volt with a magnesium sacrificial anode. Depending from the properties of the resistors and condensers the pulse frequency and length can de varied. This embodiment is also suited for a medium with a higher or lower specific resistance, e.g. sea water (approximately 35 Ohm.cm). As an alternative C1 and C2 (condenser) are connected as shown with the dotted lines. R=resistor.

Another example (not illustrated) relates to switching with the resistor of the CP-system the basis of the (germanium) transistor. In this way the current supplied by the sacrificial 5 anode can be controlled. Thus it is possible to avoid the known condition that when the specific conductance of the (corroding) medium decreases, or precipitation (scaling) onto the anode takes place, the current supplied by the sacrificial anode decreases, because the resistance of the system increases. Alternatively the basis of the transistor can be connected to a reference electrode, a redox electrode or any other electrode or measuring sensor.

The invention (e.g. the circuit of FIG. 1) can e.g. also be applied to measure or monitor the development of a bio film at the metal structure. The presence of a bio film provides a (possibly 50-100%) higher galvanic current at unchanged resistance. By monitoring the potential and/or current, the monitoring system can, if a predetermined threshold value of it is passed, provide an order to the connected biocide injection device.

With changing electrochemical potential, the chemical conditions, such as the pH, at the surface also change. From the literature it is known that due to that also the development of a bio film and macro fouling can be prevented.

The invention (e.g. the circuit of FIG. 1) could also be applied to supply (electrical) components, such as (silicon) solid state elements, IC's or accumulators. E.g. the AC coming from the astabile multivibrator is fed to a transformer and/or rectifier which is connected to the (electrical) component. E.g. the sacrificial anode can supply with RVS in sea water 100 mA, which can be transformed to 2.5 Volt and 10 mA for the electrical component/loading a battery/accumulator/condenser. With the condenser a bistabile relays can be switched, e.g. to supply intermittently current/voltage, e.g. to a sheet pile wall.

Figure 2:
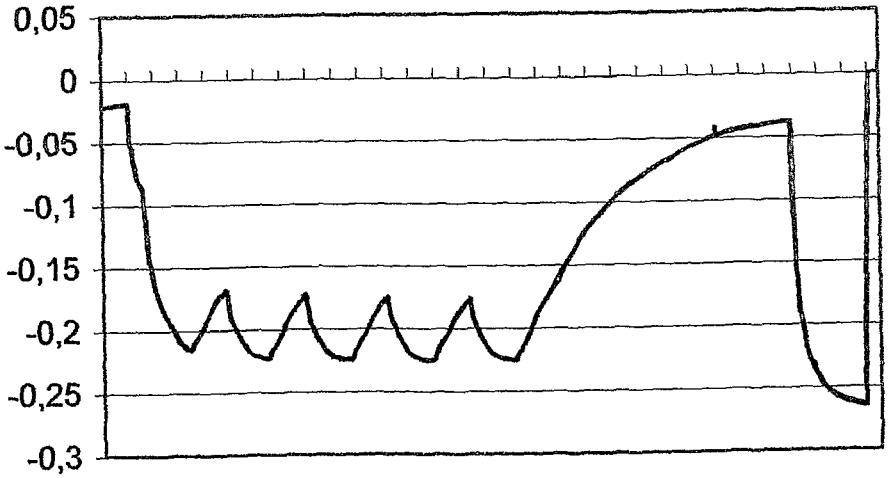
FIG. 2 a test result.

FIG. 2 shows test results of the following test rig: RVS tank 2 meters high and diameter 1.20 meter. Centrally of the tank midway its height an aluminium sacrificial anode was provided with a diameter of 120 mm and a length of 230 mm. The tank and sacrificial anode were mutually galvanically separated by an isolating layer, located between both. Between the sacrificial anode and tank the in FIG. 1 illustrated circuit was connected. The tank was completely filled with water with a specific resistance of 510 Ohm.cm. FIG. 2 shows the protecting potential in time (horizontal), measured relative to an Ag/AgCl2 reference electrode (vertical). In dependence from the values of the resistors and condensers a frequency between 1 second and a week or more, e.g. about 2.5 minute and an amplitude of 45 mV or less or more (e.g. about 300 mV) to even more than 500 mV is obtained.

All described or in the drawing illustrates features provide in isolation or arbitrary combination the subject of this invention. A MOSFET transistor is preferably not used, due to insufficient robustness.

The invention claimed is:

1. A method for operating a component of metal being exposed to a corroding medium, the component being combined with a sacrificial anode, the component and the sacrificial anode are provided in and are contacting the same corroding medium, and are mounted such that they exclusively make galvanic contact with each other through the corroding medium, and a galvanic circuit with galvanic solid state elements is used, for one or more of:

cathodic protection of the component,
measuring a condition of the component,
retarding or avoiding fouling of the component;
wherein the sacrificial anode is an energy source used in the galvanic circuit for supplying one or more of:
a pulsating current,
a voltage,
an automatic adapted galvanic current, and
a protection potential,
wherein the sacrificial anode is connected through an astable multivibrator with germanium transistors to the metal structure, wherein the sacrificial anode supplies a direct current (DC) transferred by the astabile multivibrator into an alternating current, such that a pulsating potential is supplied to the metal structure,
wherein with a resistor of the CP-system the basis of the transistor switches,
wherein the basis of the transistor is switched by a sensor.

2. The method according to claim 1, wherein the galvanic circuit provides pulsating energy by containing an astable multivibrator.

3. The method according to claim 2, wherein the component is provided by a tube, conduit, reaction vessel or heat exchanger, containing a corroding medium, wherein the sacrificial anode is present within the relative component.

4. The method according to claim 2, wherein the component is a sheet piling made of construction steel.

5. The method according to claim 1, wherein the sacrificial anode is connected through an astable multivibrator with germanium transistors to the metal structure, wherein the sacrificial anode supplies a direct current (DC) transferred by the astabile multivibrator into an alternating current, such that a pulsating potential is supplied to the metal structure.

6. The method according to claim 5, wherein with a resistor of the CP-system the basis of the transistor switches.

7. The method according to claim 1, wherein the a command is provided to a connected biocide injection device.

8. The method according to claim 1, wherein the sacrificial anode is an only source of electrons.

9. A method for operating a component of metal being exposed to a corroding medium, the component being combined with a sacrificial anode, the component and the sacrificial anode are provided in and are contacting the same corroding medium, and are mounted such that they exclusively make galvanic contact with each other through the corroding medium, and a galvanic circuit with galvanic solid state elements is used, for one or more of:

cathodic protection of the component,
measuring a condition of the component,
retarding or avoiding fouling of the component;
wherein the sacrificial anode is an energy source used in the galvanic circuit for supplying one or more of:
a pulsating current,
a voltage,
an automatic adapted galvanic current, and
a protection potential,
wherein the sacrificial anode is used to supply energy to a component, such as a solid state element, condenser, IC or battery,
wherein the alternating current coming from an astable multivibrator is fed to a transformer or rectifier.

10. The method according to claim 9, wherein the sacrificial anode is an only source of electrons.

11. The method according to claim 9, wherein the galvanic circuit provides pulsating energy by containing an astable multivibrator.

12. The method according to claim 11, wherein the component is provided by a tube, conduit, reaction vessel or heat exchanger, containing a corroding medium, wherein the sacrificial anode is present within the relative component.

13. The method according to claim 11, wherein the component is a sheet piling made of construction steel.

14. The method according to claim 9, wherein the sacrificial anode is connected through an astable multivibrator with germanium transistors to the metal structure, wherein the sacrificial anode supplies a direct current (DC) transferred by the astabile multivibrator into an alternating current, such that a pulsating potential is supplied to the metal structure.

15. The method according to claim 14, wherein with a resistor of the CP-system the basis of the transistor switches.

16. The method according to claim 9, wherein a command is provided to a connected biocide injection device.

* * * * *